US007174022B1

(12) United States Patent
Zhang et al.

(10) Patent No.: US 7,174,022 B1
(45) Date of Patent: Feb. 6, 2007

(54) SMALL ARRAY MICROPHONE FOR BEAM-FORMING AND NOISE SUPPRESSION

(75) Inventors: Ming Zhang, Cupertino, CA (US); Kuoyu Lin, San Jose, CA (US)

(73) Assignee: ForteMedia, Inc., Cupertino, CA (US)

( * ) Notice: Subject to any disclaimer, the term of this patent is extended or adjusted under 35 U.S.C. 154(b) by 713 days.

(21) Appl. No.: 10/601,055

(22) Filed: Jun. 20, 2003

Related U.S. Application Data

(60) Provisional application No. 60/426,715, filed on Nov. 15, 2002.

(51) Int. Cl.
*H04R 3/00* (2006.01)

(52) U.S. Cl. ..... 381/92; 381/94.2; 381/94.3; 704/226

(58) Field of Classification Search ..... 381/55, 381/118, 58, 92, 94.1, 94.2, 94.3, 94.7; 455/556.1, 455/74, 567, 344; 704/226, 231, 233, 246
See application file for complete search history.

(56) References Cited

U.S. PATENT DOCUMENTS 6,339,758 B1 * 1/2002 Kanazawa et al. ..... 704/226
6,937,980 B2 * 8/2005 Krasny et al. ..... 704/231
2003/0027600 A1 * 2/2003 Krasny et al. ..... 455/564
2003/0063759 A1 * 4/2003 Brennan et al. ..... 381/92

* cited by examiner

*Primary Examiner*—Brian T. Pendleton
(74) *Attorney, Agent, or Firm*—Dinh & Associates

(57) ABSTRACT

Techniques are provided to suppress noise and interference using an array microphone and a combination of time-domain and frequency-domain signal processing. In one design, a noise suppression system includes an array microphone, at least one voice activity detector (VAD), a reference generator, a beam-former, and a multi-channel noise suppressor. The array microphone includes multiple microphones—at least one omni-directional microphone and at least one uni-directional microphone. Each microphone provides a respective received signal. The VAD provides at least one voice detection signal used to control the operation of the reference generator, beam-former, and noise suppressor. The reference generator provides a reference signal based on a first set of received signals and having desired voice signal suppressed. The beam-former provides a beam-formed signal based on a second set of received signals and having noise and interference suppressed. The noise suppressor further suppresses noise and interference in the beam-formed signal.

23 Claims, 7 Drawing Sheets

SMALL ARRAY MICROPHONE FOR BEAM-FORMING AND NOISE SUPPRESSION

CROSS-REFERENCES TO RELATED APPLICATIONS

This application claims the benefit of provisional U.S. Application Ser. No. 60/426,715, entitled "Small Array Microphone for Beam-forming," filed Nov. 15, 2002, which is incorporated herein by reference in its entirety for all purposes.

This application is further related to U.S. application Ser. No. 10/076,201, entitled "Noise Suppression for a Wireless Communication Device," filed on Feb. 12, 2002, U.S. application Ser. No. 10/076,120, entitled "Noise Suppression for Speech Signal in an Automobile", filed on Feb. 12, 2002, and U.S. patent application Ser. No. 10/371,150, entitled "Small Array Microphone for Acoustic Echo Cancellation and Noise Suppression," filed Feb. 21, 2003, all of which are assigned to the assignee of the present application and incorporated herein by reference in their entirety for all purposes.

BACKGROUND OF THE INVENTION

The present invention relates generally to communication, and more specifically to techniques for suppressing noise and interference in communication and voice recognition systems using an array microphone.

Communication and voice recognition systems are commonly used for many applications, such as hands-free car kit, cellular phone, hands-free voice control devices, telematics, teleconferencing system, and so on. These systems may be operated in noisy environments, such as in a vehicle or a restaurant. For each of these systems, one or multiple microphones in the system pick up the desired voice signal as well as noise and interference. The noise typically refers to local ambient noise. The interference may be from acoustic echo, reverberation, unwanted voice, and other artifacts.

Noise suppression is often required in many communication and voice recognition systems to suppress ambient noise and remove unwanted interference. For a communication or voice recognition system operating in a noisy environment, the microphone(s) in the system pick up the desired voice as well as noise. The noise is more severe for a hands-free system whereby the loudspeaker and microphone may be located some distance away from a talking user. The noise degrades communication quality and speech recognition rate if it is not dealt with in an appropriate manner.

For a system with a single microphone, noise suppression is conventionally achieved using a spectral subtract technique. For this technique, which performs signal processing in the frequency domain, the noise power spectrum of a noisy voice signal is estimated and subtracted from the power spectrum of the noisy voice signal to obtain an enhanced voice signal. The phase of the enhanced voice signal is set equal to the phase of the noisy voice signal. This technique is somewhat effective for stationary noise or slow-varying non-stationary (such as air-conditioner noise or fan noise, which does not change over time) but may not be effective for fast-varying non-stationary noise. Moreover, even for stationary noise, this technique can cause voice distortion if the noisy voice signal has a low signal-to-noise ratio (SNR). Conventional noise suppression for stationary noise is described in various literatures including U.S. Pat. Nos. 4,185,168 and 5,768,473.

For a system with multiple microphones, an array microphone is formed by placing these microphones at different positions sufficiently far apart. The array microphone forms a signal beam that is used to suppress noise and interference outside of the beam. Conventionally, the spacing between the microphones needs to be greater than a certain minimum distance D in order to form the desired beam. This spacing requirement prevents the array microphone from being used in many applications where space is limited. Moreover, conventional beam-forming with the array microphone is typically not effective at suppressing noise in an environment with diffused noise. Conventional systems with array microphone are described in various literatures including U.S. Pat. Nos. 5,371,789, 5,383,164, 5,465,302 and 6,002,776.

As can be seen, techniques that can effectively suppress noise and interference in communication and voice recognition systems are highly desirable.

SUMMARY OF THE INVENTION

Techniques are provided herein to suppress both stationary and non-stationary noise and interference using an array microphone and a combination of time-domain and frequency-domain signal processing. These techniques are also effective at suppressing diffuse noise, which cannot be handled by a single microphone system and a conventional array microphone system. The inventive techniques can provide good noise and interference suppression, high voice quality, and faster voice recognition rate, all of which are highly desirable for hands-free full-duplex applications in communication or voice recognition systems.

The array microphone is composed of a combination of omni-directional microphones and uni-directional microphones. The microphones may be placed close to each other (i.e., closer than the minimum distance required by a conventional array microphone). This allows the array microphone to be used in various applications. The array microphone forms a signal beam at a desired direction. This beam is then used to suppress stationary and non-stationary noise and interference.

A specific embodiment of the invention provides a noise suppression system that includes an array microphone, at least one voice activity detector (VAD), a reference generator, a beam-former, and a multi-channel noise suppressor. The array microphone is composed of multiple microphones, which include at least one omni-directional microphone and at least one uni-directional microphone. Each microphone provides a respective received signal. One of the received signals is designated as the main signal, and the remaining received signal(s) are designated as secondary signal(s). The VAD(s) provide at least one voice detection signal, which is used to control the operation of the reference generator, the beam-former, and the multi-channel noise suppressor. The reference generator provides a reference signal based on the main signal, a first set of at least one secondary signal, and an intermediate signal from the beam-former. The beam-former provides the intermediate signal and a beam-formed signal based on the main signal, a second set of at least one secondary signal, and the reference signal. Depending on the number of microphones used for the array microphone, the first and second sets may include the same or different secondary signals. The reference signal has the desired voice signal suppressed, and the beam-formed signal has the noise and interference suppressed. The multi-channel noise suppressor further suppresses noise and interference in the beam-formed signal to provide an output signal having much of the noise and interference suppressed.

In one embodiment, the array microphone is composed of three microphones—one omni-directional microphone and two uni-directional microphones (which may be placed close to each other). The omni-directional microphone is referred to as the main microphone/channel and its received signal is the main signal a(n). One of the uni-directional microphones faces toward a desired talker and is referred to as a first secondary microphone/channel. Its received signal is the first secondary signal $s_1(n)$. The other uni-directional microphone faces away from the desired talker and is referred to as a second secondary microphone/channel. Its received signal is the second secondary signal $s_2(n)$.

In another embodiment, the array microphone is composed of two microphones—one omni-directional microphone and one uni-directional microphone (which again may be placed close to each other). The uni-directional microphone faces toward the desired talker and its received signal is the main signal a(n). The omni-directional microphone is the secondary microphone/channel and its received signal is the secondary signal s(n).

Various other aspects, embodiments, and features of the invention are also provided, as described in further detail below.

DESCRIPTION OF THE SPECIFIC EMBODIMENTS

For clarity, various signals and controls described herein are labeled with lower case and upper case symbols. Time-variant signals and controls are labeled with "(n)" and "(m)", where n denotes sample time and m denotes frame index. A frame is composed of L samples. Frequency-variant signals and controls are labeled with "(k,m)", where k denotes frequency bin. Lower case symbols (e.g., s(n) and d(m)) are used to denote time-domain signals, and upper case symbols (e.g., B(k,m)) are used to denote frequency-domain signals.

Figure 1:
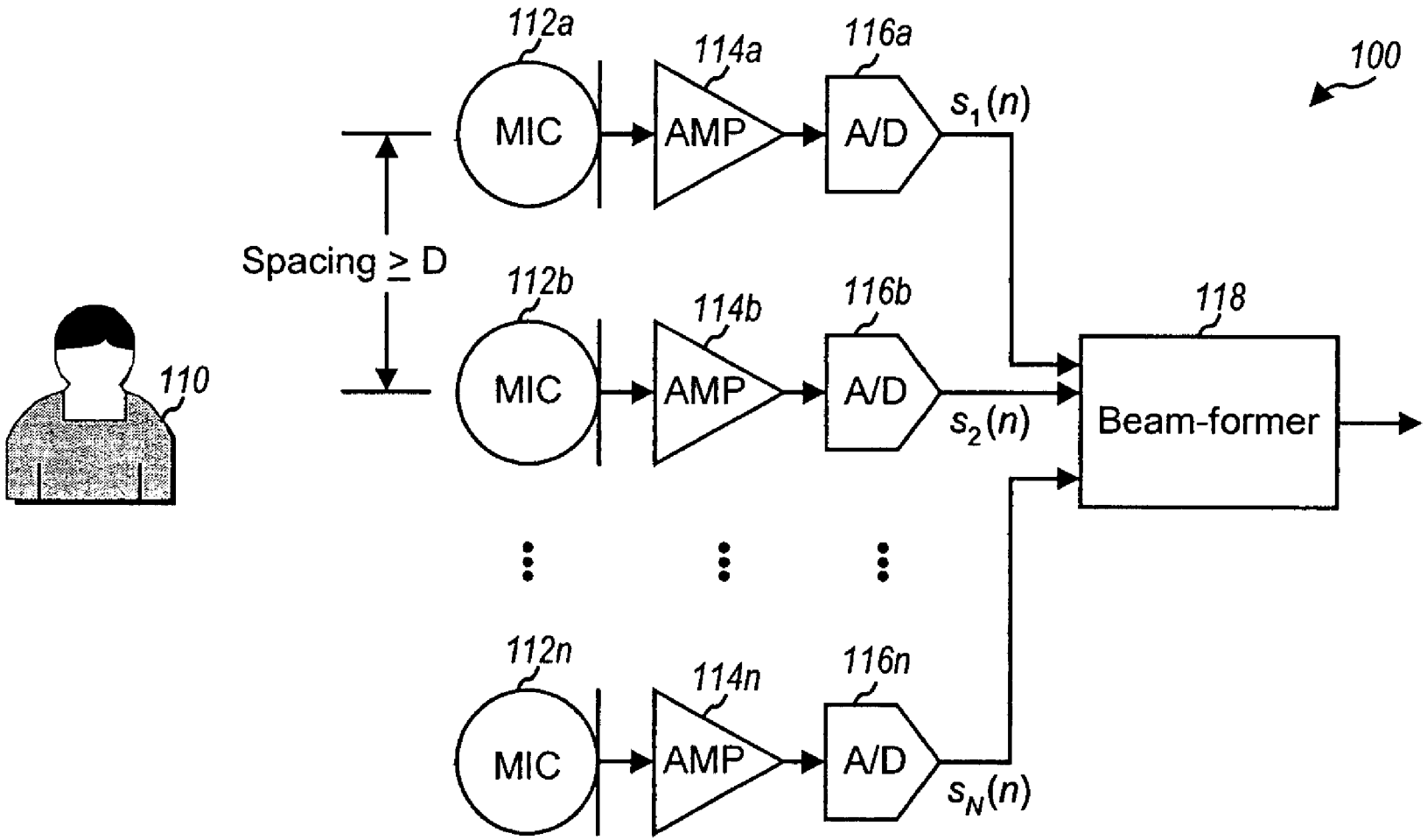
FIG. 1 shows a diagram of a conventional array microphone system.

FIG. 1 shows a diagram of a conventional array microphone system 100. System 100 includes multiple (N) microphones 112*a* through 112*n*, which are placed at different positions. The spacing between microphones 112 is required to be at least a minimum distance of D for proper operation. A preferred value for D is half of the wavelength of the band of interest for the signal. Microphones 112*a* through 112*n* receive audio activity from a talking user 110 (which is often referred to as "near-end" voice or talk), local ambient noise, and unwanted interference. The N received signals from microphones 112*a* through 112*n* are amplified by N amplifiers (AMP) 114*a* through 114*n*, respectively. The N amplified signals are further digitized by N analog-to-digital converters (A/Ds or ADCs) 116*a* through 116*n* to provide N digitized signals $s_1(n)$ through $s_N(n)$.

The N received signals, provided by N microphones 112*a* through 112*n* placed at different positions, carry information for the differences in the microphone positions. The N digitized signals $s_1(n)$ through $S_N(n)$ are provided to a beam-former 118 and used to form a signal beam. This beam is used to suppress noise and interference outside of the beam and to enhance the desired voice within the beam. Beam-former 118 may be a fixed beam-former (e.g., a delay-and-sum beam-former) or an adaptive beam-former (e.g., an adaptive sidelobe cancellation beam-former). These various types of beam-former are well known in the art. Conventional array microphone system 100 is associated with several limitations that curtail its use and/or effectiveness, including (1) requirement of a minimum distance of D for the spacing between microphones and (2) marginal effectiveness for diffused noise.

Figure 2:
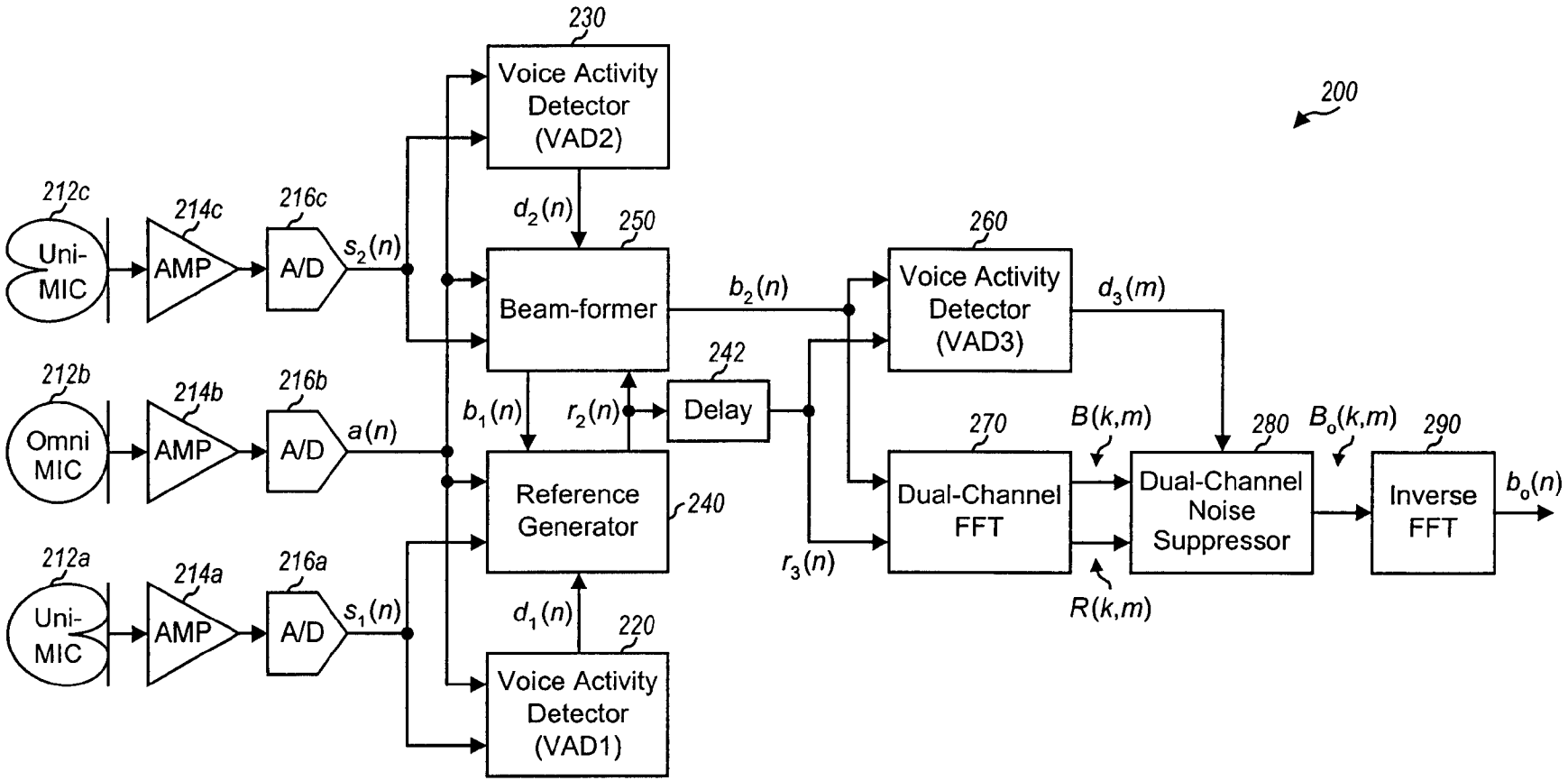
FIG. 2 shows a block diagram of a small array microphone system, in accordance with an embodiment of the invention.

FIG. 2 shows a block diagram of an embodiment of a small array microphone system 200. In general, a small array microphone system can include any number of microphones greater than one. Moreover, the microphones may be any combination of omni-directional microphones and uni-directional microphones. An omni-directional microphone picks up signal and noise from all directions. A uni-directional microphone picks up signal and noise from the direction pointed to by its main lobe. The microphones in system 200 may be placed closer than the minimum spacing distance D required by conventional array microphone system 100. For clarity, a small array microphone system with three microphones is specifically described below.

In the embodiment shown in FIG. 2, system 200 includes an array microphone that is composed of three microphones 212*a*, 212*b*, and 212*c*. More specifically, system 200 includes one omni-directional microphone 212*b* and two uni-directional microphones 212*a* and 212*c*. Omni-directional microphone 212*b* is referred to as the main microphone and is used to pick up desired voice signal as well as noise and interference. Uni-directional microphone 212*a* is the first secondary microphone which has its main lobe facing toward a desired talking user. Microphone 212*a* is used to pick up mainly the desired voice signal. Uni-directional microphone 212*c* is the second secondary microphone which has its main lobe facing away from the desired talker. Microphone 212*c* is used to pick up mainly the noise and interference.

Microphones 212*a*, 212*b*, and 212*c* provide three received signals, which are amplified by amplifiers 214*a*, 214*b*, and 214*c*, respectively. An ADC 216*a* receives and digitizes the amplified signal from amplifier 214*a* and provides a first secondary signal $s_1(n)$. An ADC 216*b* receives and digitizes the amplified signal from amplifier 214*b* and provides a main signal a(n). An ADC 216*c* receives and digitizes the amplified signal from amplifier 214*c* and provides a second secondary signal $s_2(n)$.

A first voice activity detector (VAD1) 220 receives the main signal a(n) and the first secondary signal $s_1(n)$. VAD 1 220 detects for the presence of near-end voice based on a metric of total power over noise power, as described below. VAD1 220 provides a first voice detection signal $d_1(n)$, which indicates whether or not near-end voice is detected.

A second voice activity detector (VAD2) 230 receives the main signal a(n) and the second secondary signal $s_2(n)$. VAD2 230 detects for the absence of near-end voice based on a metric of the cross-correlation between the main signal and the desired voice signal over the total power, as described below. VAD2 230 provides a second voice detection signal $d_2(n)$, which also indicates whether or not near-end voice is absent.

A reference generator 240 receives the main signal a(n), the first secondary signal $s_1(n)$, the first voice detection signal $d_1(n)$, and a first beam-formed signal $b_1(n)$. Reference generator 240 updates its coefficients based on the first voice detection signal $d_1(n)$, detects for the desired voice signal in the first secondary signal $s_1(n)$ and the first beam-formed signal $b_2(n)$, cancels the desired voice signal from the main signal a(n), and provides two reference signals $r_1(n)$ and $r_2(n)$. The reference signals $r_1(n)$ and $r_2(n)$ both contain mostly noise and interference. However, the reference signal $r_2(n)$ is more accurate than $r_1(n)$ in order to estimate the presence of noise and interference.

A beam-former 250 receives the main signal a(n), the second secondary signal $s_2(n)$, the second reference signal $r_2(n)$, and the second voice detection signal $d_2(n)$. Beam-former 250 updates its coefficients based on the second voice detection signal $d_2(n)$, detects for the noise and interference in the second secondary signal $s_2(n)$ and the second reference signal $r_2(n)$, cancels the noise and interference from the main signal a(n), and provides the two beam-formed signals $b_1(n)$ and $b_2(n)$. The beam-formed signal $b_2(n)$ is more accurate than $b_1(n)$ to represent the desired signal.

A delay unit 242 delays the second reference signal $r_2(n)$ by a delay of $T_a$ and provides a third reference signal $r_3(n)$, which is $r_3(n)=r_2(n-T_a)$. The delay $T_a$ synchronizes (i.e., time-aligns) the third reference signal $r_3(n)$ with the second beam-formed signal $b_2(n)$.

A third voice activity detector (VAD3) 260 receives the third reference signal $r_3(n)$ and the second beam-formed signal $b_2(n)$. VAD3 260 detects for the presence of near-end voice based on a metric of desired voice power over noise power, as described below. VAD3 260 provides a third voice detection signal $d_3(m)$ to dual-channel noise suppressor 280, which also indicates whether or not near-end voice is detected. The third voice detection signal $d_3(m)$ is a function of frame index m instead of sample index n.

A dual-channel FFT unit 270 receives the second beam-formed signal $b_2(n)$ and the third reference signal $r_3(n)$. FFT unit 270 transforms the signal $b_2(n)$ from the time domain to the frequency domain using an L-point FFT and provides a corresponding frequency-domain beam-formed signal B(k, m). FFT unit 270 also transforms the signal $r_3(n)$ from the time domain to the frequency domain using the L-point FFT and provides a corresponding frequency-domain reference signal R(k,m).

A dual-channel noise suppressor 280 receives the frequency-domain signals B(k,m) and R(k,m) and the third voice detection signal $d_3(m)$. Noise suppressor 280 further suppresses noise and interference in the signal B(k,m) and provides a frequency-domain output signal $B_o(k,m)$ having much of the noise and interference suppressed.

An inverse FFT unit 290 receives the frequency-domain output signal $B_o(k,m)$, transforms it from the frequency domain to the time domain using an L-point inverse FFT, and provides a corresponding time-domain output signal $b_o(n)$. The output signal $b_o(n)$ may be converted to an analog signal, amplified, filtered, and so on, and provided to a speaker.

Figure 3:
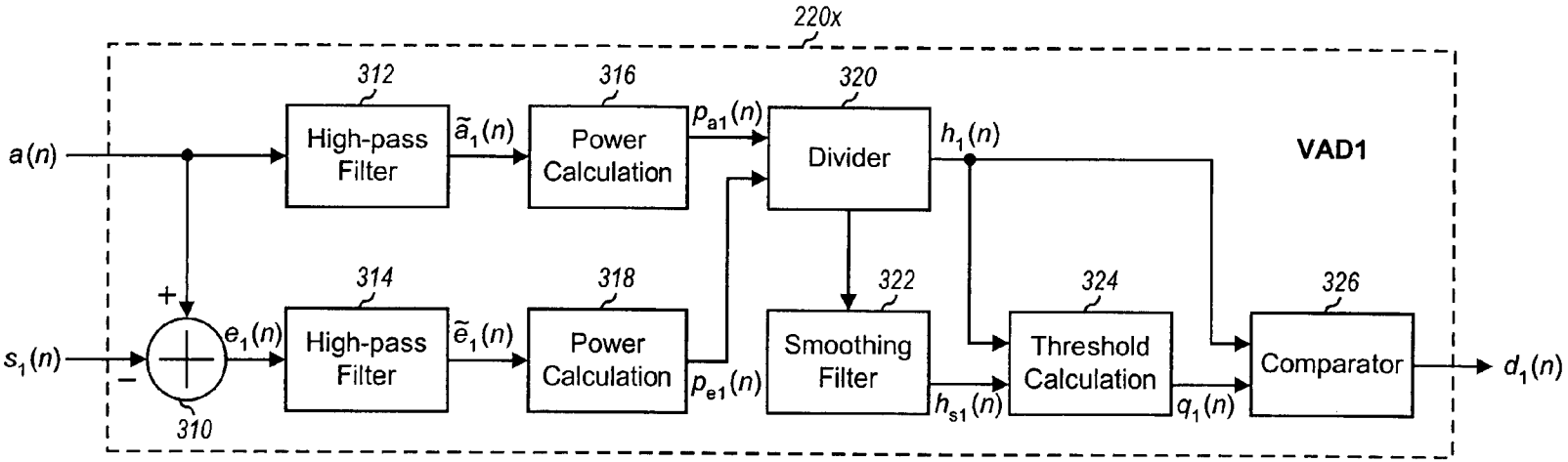
FIGS. 3 and 4 show block diagrams of a first and a second voice activity detector.

FIG. 3 shows a block diagram of a voice activity detector (VAD1) 220*x*, which is a specific embodiment of VAD 1 220 in FIG. 2. For this embodiment, VAD1 220*x* detects for the presence of near-end voice based on (1) the total power of the main signal a(n), (2) the noise power obtained by subtracting the first secondary signal $s_1(n)$ from the main signal a(n), and (3) the power ratio between the total power obtained in (1) and the noise power obtained in (2).

Within VAD 220*x*, a subtraction unit 310 subtracts the first secondary signal $s_1(n)$ from the main signal a(n) and provides a first difference signal $e_1(n)$, which is $e_1(n)=a(n)-s_1(n)$. The first difference signal $e_1(n)$ contains mostly noise and interference. High-pass filters 312 and 314 respectively receive the signals a(n) and $e_1(n)$, filter these signals with the same set of filter coefficients to remove low frequency components, and provide filtered signals $\tilde{a}_1(n)$ and $\tilde{e}_1(n)$, respectively. Power calculation units 316 and 318 then respectively receive the filtered signals $\tilde{a}_1(n)$ and $\tilde{e}_1(n)$, compute the powers of the filtered signals, and provide computed powers $p_{a1}(n)$ and $p_{e1}(n)$, respectively. Power calculation units 316 and 318 may further average the computed powers. In this case, the averaged computed powers may be expressed as:

$$p_{a1}(n)=a_1 \cdot p_{a1}(n-1)+(1-a_1)\cdot \tilde{a}_1(n)\cdot \tilde{a}_1(n), \text{ and} \quad \text{Eq (1a)}$$

$$p_{e1}(n)=a_1 \cdot p_{e1}(n-1)+(1-a_1)\cdot \tilde{e}_1(n)\cdot \tilde{e}_1(n), \quad \text{Eq(1b)}$$

where $\alpha_1$ is a constant that determines the amount of averaging and is selected such that $1>\alpha_1>0$. A large value for $\alpha_1$ corresponds to more averaging and smoothing. The term $p_{a1}(n)$ includes the total power from the desired voice signal as well as noise and interference. The term $p_{e1}(n)$ includes mostly noise and interference power.

A divider unit 320 then receives the averaged powers $p_{a1}(n)$ and $p_{e1}(n)$ and calculates a ratio $h_1(n)$ of these two powers. The ratio $h_1(n)$ may be expressed as:

$$h_1(n) = \frac{p_{a1}(n)}{p_{e1}(n)}. \quad \text{Eq (2)}$$

The ratio $h_1(n)$ indicates the amount of total power relative to the noise power. A large value for $h_1(n)$ indicates that the total power is large relative to the noise power, which may be the case if near-end voice is present. A larger value for $h_1(n)$ corresponds to higher confidence that near-end voice is present.

A smoothing filter 322 receives and filters or smoothes the ratio $h_1(n)$ and provides a smoothed ratio $h_{s1}(n)$. The smoothing may be expressed as:

$$h_{s1}(n)=\alpha_{h1}\cdot h_{s1}(n-1)+(1-\alpha_{h1})\cdot h_1(n), \quad \text{Eq (3)}$$

where $\alpha_{h1}$ is a constant that determines the amount of smoothing and is selected as $1>\alpha_{h1}>0$.

A threshold calculation unit 324 receives the instantaneous ratio $h_1(n)$ and the smoothed ratio $h_{s1}(n)$ and determines a threshold $q_1(n)$. To obtain $q_1(n)$, an initial threshold $q_1'(n)$ is first computed as:

$$q_1'(n) = \begin{cases} \alpha_{h1} \cdot q_1'(n-1) + (1-\alpha_{h1}) \cdot h_1(n), & \text{if } h_1(n) > \beta_1 h_{s1}(n) \\ q_1'(n-1), & \text{if } h_1(n) \le \beta_1 h_{s1}(n) \end{cases}, \quad \text{Eq (4)}$$

where $\beta_1$ is a constant that is selected such that $\beta_1>0$. In equation (4), if the instantaneous ratio $h_1(n)$ is greater than $\beta_1 h_{s1}(n)$, then the initial threshold $q_1'(n)$ is computed based on the instantaneous ratio $h_1(n)$ in the same manner as the smoothed ratio $h_{s1}(n)$. Otherwise, the initial threshold for the prior sample period is retained (i.e., $q_1'(n)=q_1'(n-1)$) and the initial threshold $q_1'(n)$ is not updated with $h_1(n)$. This prevents the threshold from being updated under abnormal condition for small values of $h_1(n)$.

The initial threshold $q_1'(n)$ is further constrained to be within a range of values defined by $Q_{max1}$ and $Q_{min1}$. The threshold $q_1(n)$ is then set equal to the constrained initial threshold $q_1'(n)$, which may be expressed as:

$$q_1(n)=\begin{cases} Q_{\max 1}, & \text{if } q_1'(n)>Q_{\max 1}, \\ q_1'(n), & \text{if } Q_{\max 1}\geq q_1'(n)\geq Q_{\min 1}, \text{ and} \\ Q_{\min 1}, & \text{if } Q_{\min 1}>q_1'(n), \end{cases} \quad \text{Eq (5)}$$

where $Q_{max1}$ and $Q_{min1}$ are constants selected such that $Q_{max1}>Q_{min1}$.

The threshold $q_1(n)$ is thus computed based on a running average of the ratio $h_1(n)$, where small values of $h_1(n)$ are excluded from the averaging. Moreover, the threshold $q_1(n)$ is further constrained to be within the range of values defined by $Q_{max1}$ and $Q_{min1}$. The threshold $q_1(n)$ is thus adaptively computed based on the operating environment.

A comparator 326 receives the ratio $h_1(n)$ and the threshold $q_1(n)$, compares the two quantities $h_1(n)$ and $q_1(n)$, and provides the first voice detection signal $d_1(n)$ based on the comparison results. The comparison may be expressed as:

$$d_1(n)=\begin{cases} 1, & \text{if } h_1(n)\geq q_1(n), \\ 0, & \text{if } h_1(n)<q_1(n). \end{cases} \quad \text{Eq (6)}$$

The voice detection signal $d_1(n)$ is set to 1 to indicate that near-end voice is detected and set to 0 to indicate that near-end voice is not detected.

Figure 4:
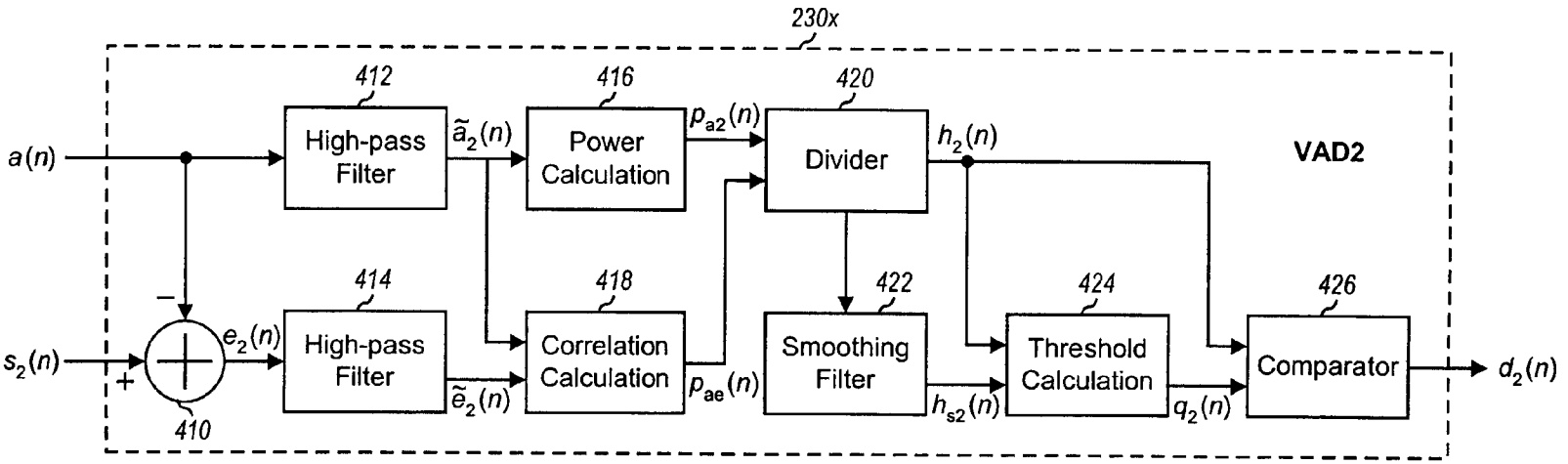

FIG. 4 shows a block diagram of a voice activity detector (VAD2) 230*x*, which is a specific embodiment of VAD2 230 in FIG. 2. For this embodiment, VAD2 230*x* detects for the absence of near-end voice based on (1) the total power of the main signal a(n), (2) the cross-correlation between the main signal a(n) and the voice signal obtained by subtracting the main signal a(n) from the second secondary signal $s_2(n)$, and (3) the ratio of the cross-correlation obtained in (2) over the total power obtained in (1).

Within VAD 230*x*, a subtraction unit 410 subtracts the main signal a(n) from the second secondary signal $s_2(n)$ and provides a second difference signal $e_2(n)$, which is $e_2(n)=s_2(n)-a(n)$. High-pass filters 412 and 414 respectively receive the signals a(n) and $e_2(n)$, filter these signals with the same set of filter coefficients to remove low frequency components, and provide filtered signals $\tilde{a}_2(n)$ and $\tilde{e}_2(n)$, respectively. The filter coefficients used for high-pass filters 412 and 414 may be the same or different from the filter coefficients used for high-pass filters 312 and 314.

A power calculation unit 416 receives the filtered signal $\tilde{a}_2(n)$, computes the power of this filtered signal, and provides the computed power $p_{a2}(n)$. A correlation calculation unit 418 receives the filtered signals $\tilde{a}_2(n)$ and $\tilde{e}_2(n)$, computes their cross correlation, and provides the correlation $p_{ae}(n)$. Units 416 and 418 may further average their computed results. In this case, the averaged computed power from unit 416 and the averaged correlation from unit 418 may be expressed as:

$$p_{a2}(n)=\alpha_2\cdot p_{a2}(n-1)+(1-\alpha_2)\cdot\tilde{a}_2(n)\cdot\tilde{a}_2(n), \text{ and} \quad \text{Eq (7a)}$$

$$p_{ae}(n)=\alpha_2\cdot p_{ae}(n-1)+(1-\alpha_2)\cdot\tilde{a}_2(n)\cdot\tilde{e}_2(n), \quad \text{Eq (7b)}$$

where $\alpha_2$ is a constant that is selected such that $1>\alpha_2>0$. The constant $\alpha_2$ for VAD2 230*x* may be the same or different from the constant $\alpha_1$ for VAD1 220*x*. The term $p_{a2}(n)$ includes the total power for the desired voice signal as well as noise and interference. The term $p_{ae}(n)$ includes the correlation between a(n) and $e_2(n)$, which is typically negative if near-end voice is present.

A divider unit 420 then receives $p_{a2}(n)$ and $p_{ae}(n)$ and calculates a ratio $h_2(n)$ of these two quantities, as follows:

$$h_2(n)=\frac{p_{ae}(n)}{p_{a2}(n)}. \quad \text{Eq (8)}$$

A smoothing filter 422 receives and filters the ratio $h_2(n)$ to provide a smoothed ratio $h_{s2}(n)$, which may be expressed as:

$$h_{s2}(n)=\alpha_{h2}\cdot h_{s2}(n-1)+(1-\alpha_{h2})\cdot h_2(n), \quad \text{Eq(9)}$$

where $\alpha_{h2}$ is a constant that is selected such that $1>\alpha_{h2}>0$. The constant $\alpha_{h2}$ for VAD2 230*x* may be the same or different from the constant $\alpha_{h1}$ for VAD1 220*x*.

A threshold calculation unit 424 receives the instantaneous ratio $h_2(n)$ and the smoothed ratio $h_{s2}(n)$ and determines a threshold $q_2(n)$. To obtain $q_2(n)$, an initial threshold $q_2'(n)$ is first computed as:

$$q_2'(n)=\begin{cases} \alpha_{h2}\cdot q_2'(n-1)+(1+\alpha_{h2})\cdot h_2(n), & \text{if } h_2(n)>\beta_2 h_{s2}(n), \\ q_2'(n-1), & \text{if } h_2(n)\leq\beta_2 h_{s2}(n), \end{cases} \quad \text{Eq (10)}$$

where $\beta_2$ is a constant that is selected such that $\beta_2>0$. The constant $\beta_2$ for VAD2 230*x* may be the same or different from the constant $\beta_1$ for VAD 1 220*x*. In equation (10), if the instantaneous ratio $h_2(n)$ is greater than $\beta_2 h_{s2}(n)$, then the initial threshold $q_2'(n)$ is computed based on the instantaneous ratio $h_2(n)$ in the same manner as the smoothed ratio $h_{s2}(n)$. Otherwise, the initial threshold for the prior sample period is retained.

The initial threshold $q_2'(n)$ is further constrained to be within a range of values defined by $Q_{max2}$ and $Q_{min2}$. The threshold $q_2(n)$ is then set equal to the constrained initial threshold $q_2'(n)$, which may be expressed as:

$$q_2(n)=\begin{cases} Q_{\max 2}, & \text{if } q_2'(n)>Q_{\max 2}, \\ q_2'(n), & \text{if } Q_{\max 2}\geq q_2'(n)\geq Q_{\min 2}, \text{ and} \\ Q_{\min 2}, & \text{if } Q_{\min 2}> q_2'(n), \end{cases} \quad \text{Eq (11)}$$

where $Q_{max2}$ and $Q_{min2}$ are constants selected such that $Q_{max2}>Q_{min2}$.

A comparator 426 receives the ratio $h_2(n)$ and the threshold $q_2(n)$, compares the two quantities $h_2(n)$ and $q_2(n)$, and provides the second voice detection signal $d_2(n)$ based on the comparison results. The comparison may be expressed as:

$$d_2(n) = \begin{cases} 1, & \text{if } h_2(n) \geq q_2(n), \\ 0, & \text{if } h_2(n) < q_2(n). \end{cases} \quad \text{Eq (12)}$$

The voice detection signal $d_2(n)$ is set to 1 to indicate that near-end voice is absent and set to 0 to indicate that near-end voice is present.

Figure 5:
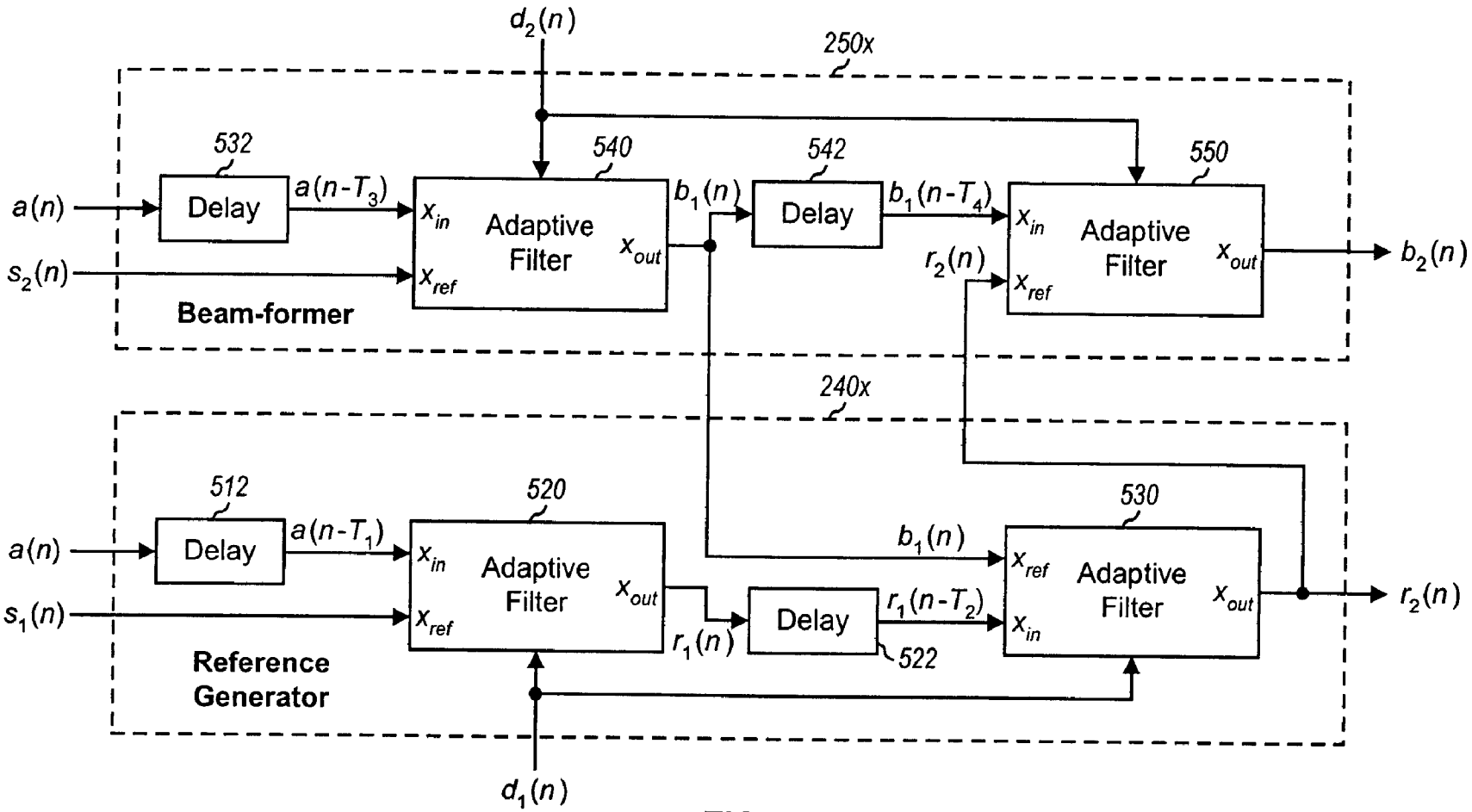
FIG. 5 shows a block diagram of a reference generator and a beam-former.

FIG. 5 shows a block diagram of a reference generator 240*x* and a beam-former 250*x*, which are specific embodiments of reference generator 240 and beam-former 250, respectively, in FIG. 2.

Within reference generator 240*x*, a delay unit 512 receives and delays the main signal a(n) by a delay of $T_1$ and provides a delayed signal $a(n-T_1)$. The delay $T_1$ accounts for the processing delays of an adaptive filter 520. For linear FIR-type adaptive filter, $T_1$ is set to equal to half the filter length. Adaptive filter 520 receives the delayed signal $a(n-T_1)$ at its $x_{in}$ input, the first secondary signal $s_1(n)$ at its $x_{ref}$ input, and the first voice detection signal $d_1(n)$ at its control input. Adaptive filter 520 updates its coefficients only when the first voice detection signal $d_1(n)$ is 1. These coefficients are then used to isolate the desired voice component in the first secondary signal $s_1(n)$. Adaptive filter 520 then cancels the desired voice component from the delayed signal $a(n-T_1)$ and provides the first reference signal $r_1(n)$ at its $x_{out}$ output. The first reference signal $r_1(n)$ contains mostly noise and interference. An exemplary design for adaptive filter 520 is described below.

A delay unit 522 receives and delays the first reference signal $r_1(n)$ by a delay of $T_2$ and provides a delayed signal $r_1(n-T_2)$. The delay $T_2$ accounts for the difference in the processing delays of adaptive filters 520 and 540 and the processing delay of an adaptive filter 530. Adaptive filter 530 receives the first beam-formed signal $b_1(n)$ at its $x_{ref}$ input, the delayed signal $r_1(n-T_2)$ at its $x_{in}$ input, and the first voice detection signal $d_1(n)$ at its control input. Adaptive filter 530 updates its coefficients only when the first voice detection signal $d_1(n)$ is 1. These coefficients are then used to isolate the desired voice component in the first beam-formed signal $b_1(n)$. Adaptive filter 530 then further cancels the desired voice component from the delayed signal $r_1(n-T_2)$ and provides the second reference signal $r_2(n)$ at its $x_{out}$ output. The second reference signal $r_2(n)$ contains mostly noise and interference. The use of two adaptive filters 520 and 530 to generate the reference signals can provide improved performance.

Within beam-former 250*x*, a delay unit 532 receives and delays the main signal a(n) by a delay of $T_3$ and provides a delayed signal $a(n-T_3)$. The delay $T_3$ accounts for the processing delays of adaptive filter 540. For linear FIR-type adaptive filter, $T_3$ is set to equal to half the filter length. Adaptive filter 540 receives the delayed signal $a(n-T_3)$ at its $x_{in}$ input, the second secondary signal $s_2(n)$ at its $x_{ref}$ input, and the second voice detection signal $d_2(n)$ at its control input. Adaptive filter 540 updates its coefficients only when the second voice detection signal $d_2(n)$ is 1. These coefficients are then used to isolate the noise and interference component in the second secondary signal $s_2(n)$. Adaptive filter 540 then cancels the noise and interference component from the delayed signal $a(n-T_3)$ and provides the first beam-formed signal $b_1(n)$ at its $x_{out}$ output. The first beam-formed signal $b_1(n)$ contains mostly the desired voice signal.

A delay unit 542 receives and delays the first beam-formed signal $b_1(n)$ by a delay of $T_4$ and provides a delayed signal $b_1(n-T_4)$. The delay $T_4$ accounts for the total processing delays of adaptive filters 530 and 550. Adaptive filter 550 receives the delayed signal $b_1(n-T_4)$ at its $x_{in}$ input, the second reference signal $r_2(n)$ at its $x_{ref}$ input, and the second voice detection signal $d_2(n)$ at its control input. Adaptive filter 550 updates its coefficients only when the second voice detection signal $d_2(n)$ is 1. These coefficients are then used to isolate the noise and interference component in the second reference signal $r_2(n)$. Adaptive filter 550 then cancels the noise and interference component from the delayed signal $b_1(n-T_4)$ and provides the second beam-formed signal $b_2(n)$ at its $x_{out}$ output. The second beam-formed signal $b_2(n)$ contains mostly the desired voice signal.

Figure 6:
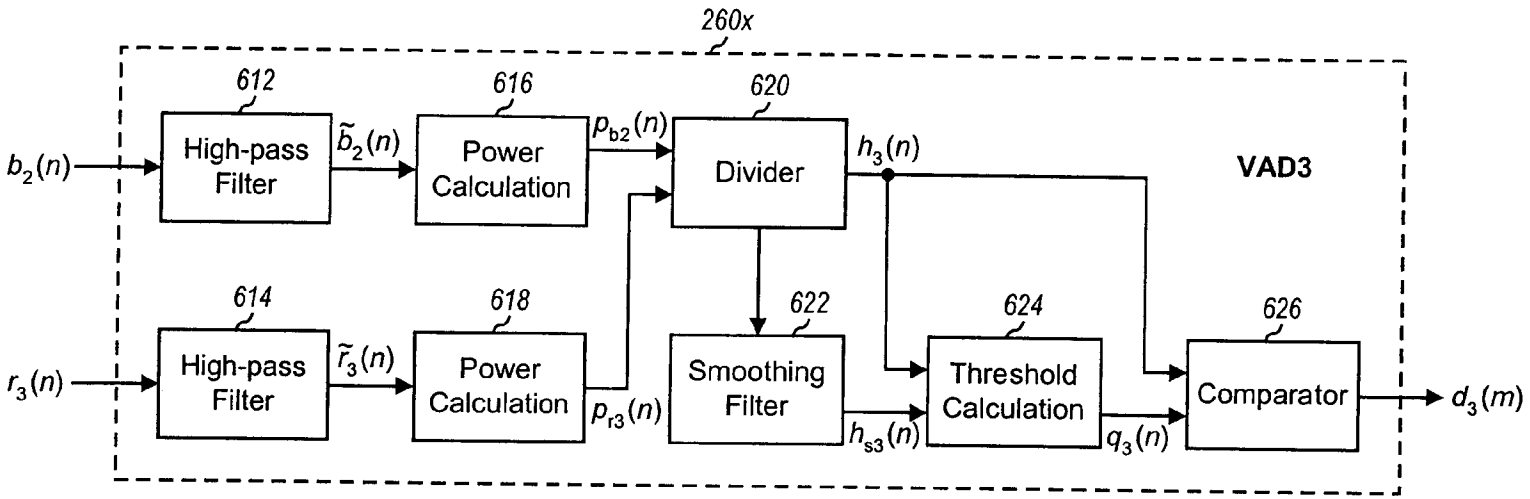
FIG. 6 shows a block diagram of a third voice activity detector.

FIG. 6 shows a block diagram of a voice activity detector (VAD3) 260*x*, which is a specific embodiment of VAD3 260 in FIG. 2. For this embodiment, VAD3 260*x* detects for the presence of near-end voice based on (1) the desired voice power of the second beam-formed signals $b_2(n)$ and (2) the noise power of the third reference signal $r_3(n)$.

Within VAD 260*x*, high-pass filters 612 and 614 respectively receive the second beam-formed signal $b_2(n)$ from beam-former 250 and the third reference signal $r_3(n)$ from delay unit 242, filter these signals with the same set of filter coefficients to remove low frequency components, and provide filtered signals $\tilde{b}_2(n)$ and $\tilde{r}_3(n)$, respectively. Power calculation units 616 and 618 then respectively receive the filtered signals $\tilde{b}_2(n)$ and $\tilde{r}_3(n)$, compute the powers of the filtered signals, and provide computed powers $p_{b2}(n)$ and $p_{r3}(n)$, respectively. Power calculation units 616 and 618 may further average the computed powers. In this case, the averaged computed powers may be expressed as:

$$p_{b2}(n)=\alpha_3 \cdot p_{b2}(n-1)+(1-\alpha_3)\cdot \tilde{b}_2(n)\cdot \tilde{b}_2(n), \text{ and} \quad \text{Eq(13a)}$$

$$p_{r3}(n)=\alpha_3 \cdot p_{r3}(n-1)+(1-\alpha_3)\cdot \tilde{r}_3(n)\cdot \tilde{r}_3(n), \quad \text{Eq(13b)}$$

where $\alpha_3$ is a constant that is selected such that $1>\alpha_3>0$. The constant $\alpha_3$ for VAD3 260*x* may be the same or different from the constant $\alpha_2$ for VAD2 230*x* and the constant $\alpha_1$ for VAD1 220*x*.

A divider unit 620 then receives the averaged powers $p_{b2}(n)$ and $p_{r3}(n)$ and calculates a ratio $h_3(n)$ of these two powers, as follows:

$$h_3(n) = \frac{p_{b2}(n)}{p_{r3}(n)}. \quad \text{Eq (14)}$$

The ratio $h_3(n)$ indicates the amount of desired voice power relative to the noise power.

A smoothing filter 622 receives and filters the ratio $h_3(n)$ to provide a smoothed ratio $h_{s3}(n)$, which may be expressed as:

$$h_{s3}(n)=\alpha_{h3}\cdot h_{s3}(n-1)+(1-\alpha_{h3})\cdot h_3(n), \quad \text{Eq (15)}$$

where $\alpha_{h3}$ is a constant that is selected such that $1>\alpha_{h3}>0$. The constant $\alpha_{h3}$ for VAD3 260*x* may be the same or different from the constant $\alpha_{h2}$ for VAD2 230*x* and the constant $\alpha_{h1}$ for VAD1 220*x*.

A threshold calculation unit 624 receives the instantaneous ratio $h_3(n)$ and the smoothed ratio $h_{s3}(n)$ and determines a threshold $q_3(n)$. To obtain $q_3(n)$, an initial threshold $q_3'(n)$ is first computed as:

$$q_3'(n) = \begin{cases} \alpha_{h3} \cdot q_3'(n-1) + (1+\alpha_{h3}) \cdot h_3(n), & \text{if } h_3(n) > \beta_3 h_{s3}(n), \\ q_3'(n-1), & \text{if } h_3(n) \le \beta_3 h_{s3}(n), \end{cases} \quad \text{Eq (16)}$$

where $\beta_3$ is a constant that is selected such that $\beta_3>0$. In equation (16), if the instantaneous ratio $h_3(n)$ is greater than $\beta_3 h_{s3}(n)$, then the initial threshold $q_3'(n)$ is computed based on the instantaneous ratio $h_3(n)$ in the same manner as the smoothed ratio $h_{s3}(n)$. Otherwise, the initial threshold for the prior sample period is retained.

The initial threshold $q_3(n)$ is further constrained to be within a range of values defined by $Q_{max3}$ and $Q_{min3}$. The threshold $q_3(n)$ is then set equal to the constrained initial threshold $q_3'(n)$, which may be expressed as:

$$q_3(n) = \begin{cases} Q_{\max 3}, & \text{if } q_3'(n) > Q_{\max 3}, \\ q_3'(n), & \text{if } Q_{\max 3} \ge q_3'(n) \ge Q_{\min 3}, \text{ and} \\ Q_{\min 3}, & \text{if } Q_{\min 3} > q_3'(n). \end{cases} \quad \text{Eq (17)}$$

where $Q_{max3}$ and $Q_{min3}$ are constants selected such that $Q_{max3}>Q_{min3}$.

A comparator 626 receives the ratio $h_3(n)$ and the threshold $q_3(n)$ and averages these quantities over each frame m. For each frame, the ratio $h_3(m)$ is obtained by accumulating L values for $h_3(n)$ for that frame and dividing by L. The threshold $q_3(m)$ is obtained in similar manner. Comparator 626 then compares the two averaged quantities $h_3(m)$ and $q_3(m)$ for each frame m and provides the third voice detection signal $d_3(m)$ based on the comparison result. The comparison may be expressed as:

$$d_3(m) = \begin{cases} 1, & \text{if } h_3(m) \ge q_3(m), \\ 0, & \text{if } h_3(m) < q_3(m). \end{cases} \quad \text{Eq (18)}$$

The third voice detection signal $d_3(m)$ is set to 1 to indicate that near-end voice is detected and set to 0 to indicate that near-end voice is not detected. However, the metric used by VAD3 is different from the metrics used by VAD1 and VAD2.

Figure 7:
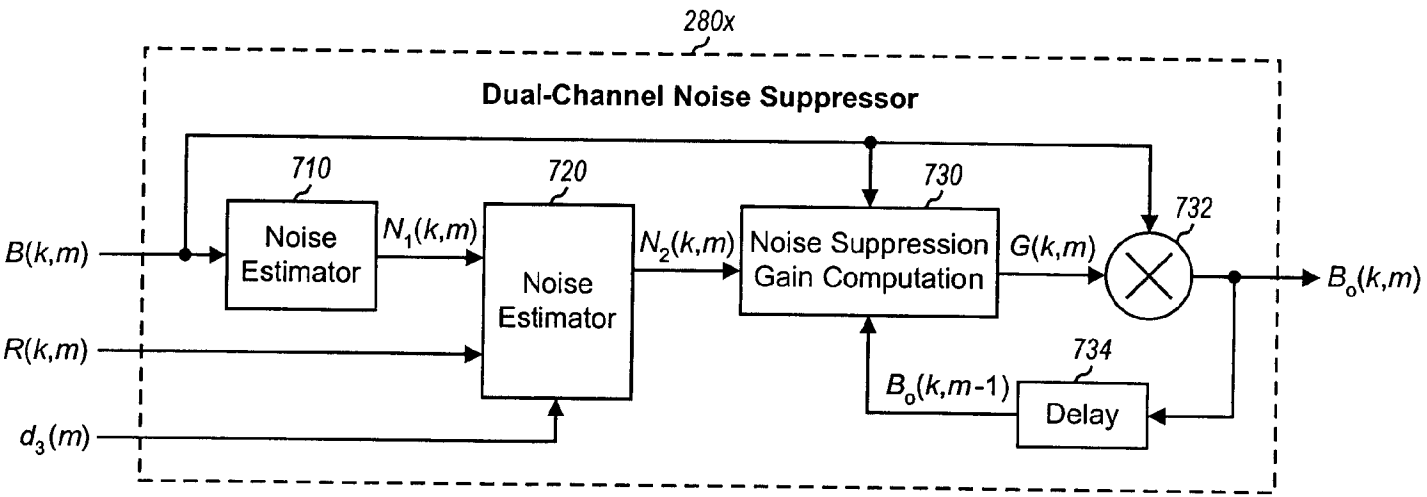
FIG. 7 shows a block diagram of a dual-channel noise suppressor.

FIG. 7 shows a block diagram of a dual-channel noise suppressor 280*x*, which is a specific embodiment of dual-channel noise suppressor 280 in FIG. 2. The operation of noise suppressor 280*x* is controlled by the third voice detection signal $d_3(m)$.

Within noise suppressor 280*x*, a noise estimator 710 receives the frequency-domain beam-formed signal B(k,m) from FFT unit 270, estimates the magnitude of the noise in the signal B(k,m), and provides a frequency-domain noise signal $N_1(k,m)$. The noise estimation may be performed using a minimum statistics based method or some other method, as is known in the art. The minimum statistics based method is described by R. Martin, in a paper entitled "Spectral subtraction based on minimum statistics," EUSIPCO'94, pp. 1182–1185, September 1994. A noise estimator 720 receives the noise signal $N_1(k,m)$, the frequency-domain reference signal R(k,m), and the third voice detection signal $d_3(m)$. Noise estimator 720 determines a final estimate of the noise in the signal B(k,m) and provides a final noise estimate $N_2(k,m)$, which may be expressed as:

$$N_2(k, m) = \begin{cases} \gamma_{a1} \cdot N_1(k, m) + \gamma_{a2} \cdot |R(k, m)|, & \text{if } d_3(m) = 1, \\ \gamma_{b1} \cdot N_1(k, m) + \gamma_{b2} \cdot |R(k, m)|, & \text{if } d_3(m) = 0, \end{cases} \quad \text{Eq (19)}$$

where $\gamma_{a1}$, $\gamma_{a2}$, $\gamma_{b1}$, and $\gamma_{b2}$ are constants and are selected such that $\gamma_{a1}>\gamma_{b1}>0$ and $\gamma_{b2}>\gamma_{a2}>0$. As shown in equation (19), the final noise estimate $N_2(k,m)$ is set equal to the sum of a first scaled noise estimate, $\gamma_{x1} \cdot N_1(k,m)$, and a second scaled noise estimate, $\gamma_{x2} \cdot |R(k,m)|$, where $\gamma_x$ can be equal to $\gamma_a$ or $\gamma_b$. The constants $\gamma_{a1}$, $\gamma_{a2}$, $\gamma_{b1}$, and $\gamma_{b2}$ are selected such that the final noise estimate $N_2(k,m)$ includes more of the noise estimate $N_1(k,m)$ and less of the reference signal magnitude $|R(k,m)|$ when $d_3(m)=1$, indicating that near-end voice is detected. Conversely, the final noise estimate $N_2(k,m)$ includes less of the noise estimate $N_1(k,m)$ and more of the reference signal magnitude $|R(k,m)|$ when $d_3(m)=0$, indicating that near-end voice is not detected.

A noise suppression gain computation unit 730 receives the frequency-domain beam-formed signal B(k,m), the final noise estimate $N_2(k,m)$, and the frequency-domain output signal $B_o(k, m-1)$ for a prior frame from a delay unit 734. Computation unit 730 computes a noise suppression gain G(k,m) that is used to suppress additional noise and interference in the signal B(k,m).

To obtain the gain G(k,m), an SNR estimate $G'_{SNR,B}(k,m)$ for the beam-formed signal B(k,m) is first computed as follows:

$$G'_{SNR,B}(k, m) = \frac{|B(k, m)|}{N_2(k, m)} - 1. \quad \text{Eq (20)}$$

The SNR estimate $G'_{SNR,B}(k,m)$ is then constrained to be a positive value or zero, as follows:

$$G_{SNR,B}(k, m) = \begin{cases} G'_{SNR,B}(k, m), & \text{if } G'_{SNR,B}(k, m) \ge 0, \\ 0, & \text{if } G'_{SNR,B}(k, m) < 0. \end{cases} \quad \text{Eq (21)}$$

A final SNR estimate $G_{SNR}(k,m)$ is then computed as follows:

$$G_{SNR}(k, m) = \frac{\lambda \cdot |B_o(k, m-1)|}{N_2(k, m)} + (1-\lambda) \cdot G_{SNR,B}(k, m), \quad \text{Eq (22)}$$

where $\lambda$ is a positive constant that is selected such that $1>\lambda>0$. As shown in equation (22), the final SNR estimate $G_{SNR}(k,m)$ includes two components. The first component is a scaled version of an SNR estimate for the output signal in the prior frame, i.e., $\lambda \cdot |B_o(k, m-1)|/N_2(k,m)$. The second component is a scaled version of the constrained SNR estimate for the beam-formed signal, i.e., $(1-\lambda) \cdot G_{SNR,B}(k, m)$. The constant $\lambda$ determines the weighting for the two components that make up the final SNR estimate $G_{SNR}(k,m)$.

The gain G(k,m) is then computed as:

$$G(k, m) = \frac{G_{SNR}(k, m)}{1 + G_{SNR}(k, m)}. \quad \text{Eq (23)}$$

The gain G(k,m) is a real value and its magnitude is indicative of the amount of noise suppression to be performed. In particular, G(k,m) is a small value for more noise suppression and a large value for less noise suppression.

A multiplier 732 then multiples the frequency-domain beam-formed signal B(k,m) with the gain G(k,m) to provide the frequency-domain output signal $B_o(k,m)$, which may be expressed as:

$$B_o(k,m)=B(k,m)\cdot G(k,m) \quad \text{Eq (24)}$$

Figure 8:
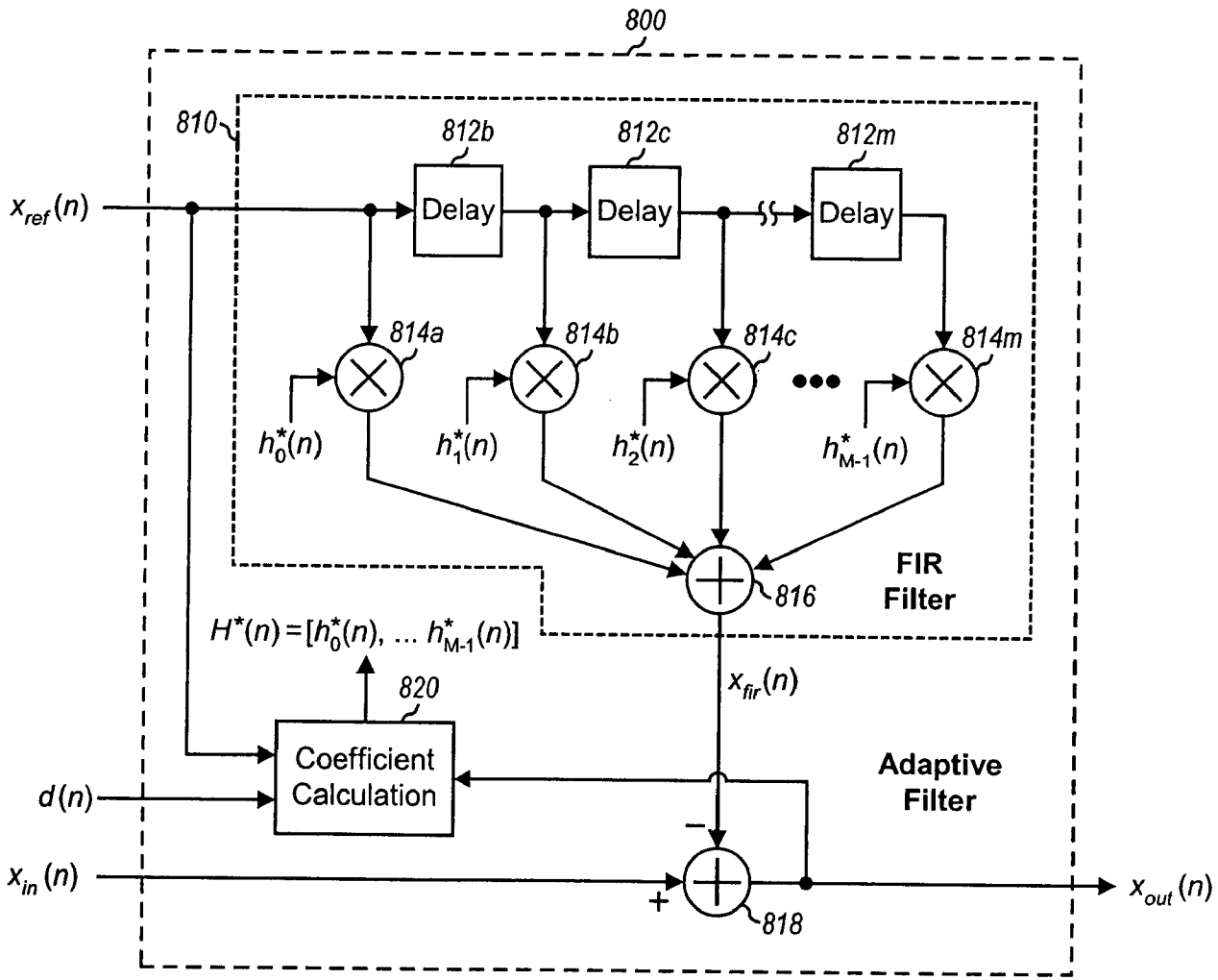
FIG. 8 shows a block diagram of an adaptive filter.

FIG. 8 shows a block diagram of an embodiment of an adaptive filter 800, which may be used for each of adaptive filters 520, 530, 540, and 550 in FIG. 5. Adaptive filter 800 includes a FIR filter 810, summer 818, and a coefficient computation unit 820. An infinite impulse response (IIR) filter or some other filter structure may also be used in place of the FIR filter. In FIG. 8, the signal received on the $x_{ref}$ input is denoted as $x_{ref}(n)$, the signal received on the $x_{in}$ input is denoted as $x_{in}(n)$, the signal received on the control input is denoted as d(n), and the signal provided to the $x_{out}$, output is denoted as $x_{out}(n)$.

Within FIR filter 810, the digital samples for the reference signal $x_{ref}(n)$ are provided to M−1 series-coupled delay elements 812*b* through 812*m*, where M is the number of taps of the FIR filter. Each delay element provides one sample period of delay. The reference signal $x_{ref}(n)$ and the outputs of delay elements 812*b* through 812*m* are provided to multipliers 814*a* through 814*m*, respectively. Each multiplier 814 also receives a respective filter coefficient $h_i(n)$ from coefficient calculation unit 820, multiplies its received samples with its filter coefficient $h_i(n)$, and provides output samples to a summer 816. For each sample period n, summer 816 sums the M output samples from multipliers 814*a* through 814*m* and provides a filtered sample for that sample period. The filtered sample $x_{fir}(n)$ for sample period n may be computed as:

$$x_{fir}(n) = \sum_{i=0}^{M-1} h_i^* \cdot x_{ref}(n-i), \quad \text{Eq (25)}$$

where the symbol "*" denotes a complex conjugate. Summer 818 receives and subtracts the FIR signal $x_{fir}(n)$ from the input signal $x_{in}(n)$ and provides the output signal $x_{out}(n)$.

Coefficient calculation unit 820 provides the set of M coefficients for FIR filter 810, which is denoted as $H^*(n)=[h_0^*(n), h_1^*(n), \ldots h_{M-1}^*(n)]$. Unit 820 further updates these coefficients based on a particular adaptive algorithm, which may be a least mean square (LMS) algorithm, a normalized least mean square (NLMS) algorithm, a recursive least square (RLS) algorithm, a direct matrix inversion (DMI) algorithm, or some other algorithm. The NLMS and other algorithms are described by B. Widrow and S. D. Sterns in a book entitled "Adaptive Signal Processing," Prentice-Hall Inc., Englewood Cliffs, N.J., 1986. The LMS, NLMS, RLS, DMI, and other adaptive algorithms are described by Simon Haykin in a book entitled "Adaptive Filter Theory", 3rd edition, Prentice Hall, 1996. Coefficient update unit 820 also receives the control signal d(n) from VAD1 or VAD2, which controls the manner in which the filter coefficients are updated. For example, the filter coefficients may be updated only when voice activity is detected (i.e., when d(n)=1) and may be maintained when voice activity is not detected (i.e., when d(n)=0).

For clarity, a specific design for the small array microphone system has been described above, as shown in FIG. 2. Various alternative designs may also be provided for the small array microphone system, and this is within the scope of the invention. These alternative designs may include fewer, different, and/or additional processing units than those shown in FIG. 2. Also for clarity, specific embodiments of various processing units within small array microphone system 200 have been described above. Other designs may also be used for each of the processing units shown in FIG. 2, and this is within the scope of the invention. For example, VAD1 and VAD3 may detect for the presence of near-end voice based on some other metrics than those described above. As another example, reference generator 240 and beam-former 250 may be implemented with different number of adaptive filters and/or different designs than the ones shown in FIG. 5.

Figure 9:
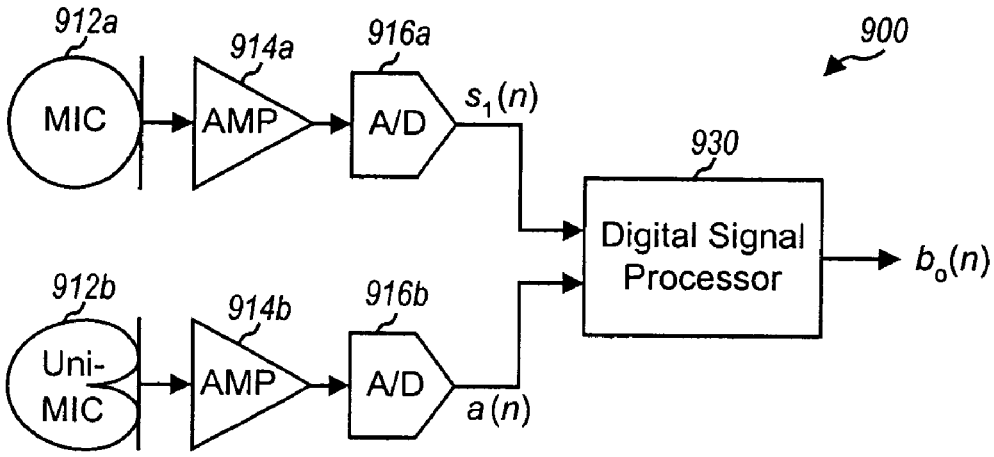
FIG. 9 shows a block diagram of another embodiment of the small array microphone system.

FIG. 9 shows a diagram of an embodiment of another small array microphone system 900. System 900 includes an array microphone composed of two microphones 912*a* and 912*b*. More specifically, system 900 includes one omni-directional microphone 912*a* and one uni-directional microphone 912*b*, which may be placed close to each other (i.e., closer than the distance D required for the conventional array microphone). Uni-directional microphone 912*b* is the main microphone which has a main lobe facing toward the desired talker. Microphone 912*b* is used to pick up the desired voice signal. Omni-directional microphone 912*a* is the secondary microphone. Microphones 912*a* and 912*b* provide two received signals, which are amplified by amplifiers 914*a* and 914*b*, respectively. An ADC 916*a* receives and digitizes the amplified signal from amplifier 914*a* and provides the secondary signal $s_1(n)$. An ADC 916*b* receives and digitizes the amplified signal from amplifier 914*b* and provides the main signal a(n). The noise and interference suppression for system 900 may be performed as described in the aforementioned U.S. patent application Ser. No. 10/371,150.

Figure 10:
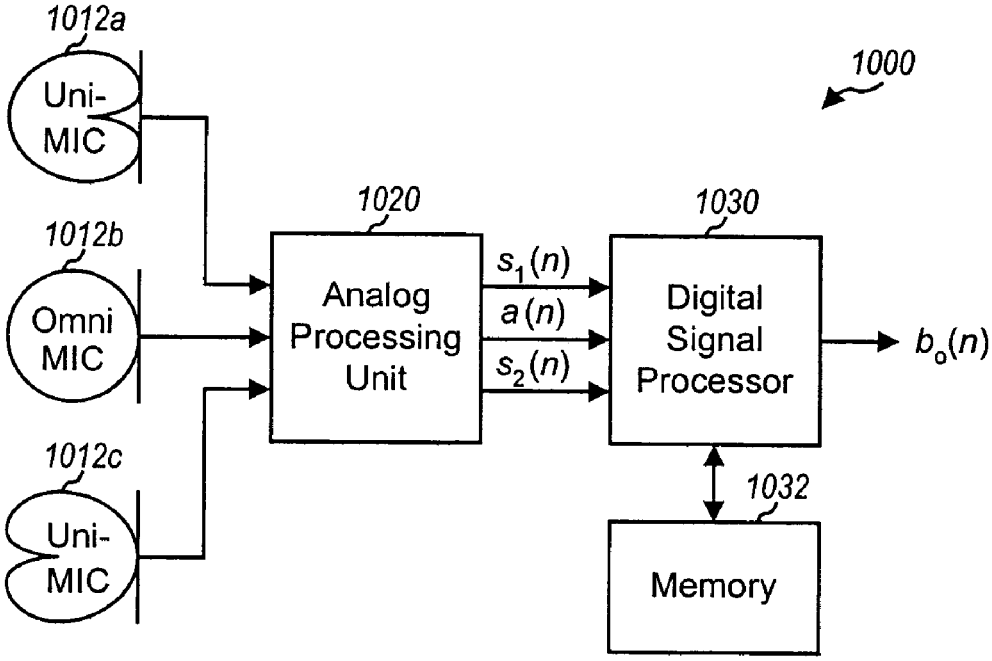
FIG. 10 shows a diagram of an implementation of the small array microphone system.

FIG. 10 shows a diagram of an implementation of a small array microphone system 1000. In this implementation, system 1000 includes three microphones 101 2*a* through 1012*c*, an analog processing unit 1020, a digital signal processor (DSP) 1030, and a memory 1032. Microphones 1012*a* through 1012*c* may correspond to microphones 212*a* through 212*c* in FIG. 2. Analog processing unit 1020 performs analog processing and may include amplifiers 214*a* through 214*c* and ADCs 216*a* through 216*c* in FIG. 2. Digital signal processor 1030 may implement various processing units used for noise and interference suppression, such as VAD1 220, VAD2 230, VAD3 260, reference generator 240, beam-former 250, FFT unit 270, noise suppressor 280, and inverse FFT unit 290 in FIG. 2. Memory 1032 provides storage for program codes and data used by digital signal processor 1030.

The array microphone and noise suppression techniques described herein may be implemented by various means. For example, these techniques may be implemented in hardware, software, or a combination thereof. For a hardware implementation, the processing units used to implement the array microphone and noise suppression may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

For a software implementation, the array microphone and noise suppression techniques may be implemented with modules (e.g., procedures, functions, and so on) that perform the functions described herein. The software codes may be stored in a memory unit (e.g., memory unit 1032 in FIG. 10) and executed by a processor (e.g., DSP 1030).

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A noise suppression system comprising:

an array microphone comprised of a plurality of microphones and operative to provide a plurality of received signals, one received signal for each microphone, wherein the plurality of microphones include at least one omni-directional microphone and at least one uni-directional microphone;

at least one voice activity detector operative to provide first and second voice detection signals based on the plurality of received signals;

a reference generator operative to provide a reference signal based on the first voice detection signal and a first set of received signals selected from among the plurality of received signals;

a beam-former operative to provide a beam-formed signal based on the second voice detection signal, the reference signal, and a second set of received signals selected from among the plurality of received signals, wherein the beam-formed signal has noise and interference suppressed; and a multi-channel noise suppressor operative to further suppress noise and interference in the beam-formed signal and provide an output signal.

2. The system of claim 1, wherein the reference generator is operative to provide the reference signal having substantially noise and interference, and wherein the beam-former is operative to suppress the noise and interference in the beam-formed signal using the reference signal.

3. The system of claim 1, wherein the reference generator includes a first set of at least one adaptive filter operative to filter the first set of received signals and an intermediate signal from the beam-former to provide the reference signal, and wherein the beam-former includes a second set of at least one adaptive filter operative to filter the second set of received signals and the reference signal to provide the beam-formed signal.

4. The system of claim 1, wherein the reference generator and the beam-former are operative to perform time-domain signal processing.

5. The system of claim 1, wherein the multi-channel noise suppressor is operative to perform frequency-domain signal processing.

6. The system of claim 1, wherein the multi-channel noise suppressor is operative to derive a gain value indicative of an estimated amount of noise and interference in the beam-formed signal and to suppress the noise and interference in the beam-formed signal with the gain value.

7. The system of claim 1, wherein the estimated amount of noise and interference in the beam-formed signal is determined based on the reference signal, the beam-formed signal, and the output signal.

8. The system of claim 1, wherein the at least one voice activity detector includes a first voice activity detector operative to provide the first voice detection signal based on the first set of received signals.

9. The system of claim 8, wherein the first voice detection signal is determined based on a ratio of total power over noise power.

10. The system of claim 8, wherein the at least one voice activity detector further includes a second voice activity detector operative to provide the second voice detection signal based on the second set of received signals.

11. The system of claim 10, wherein the second voice detection signal is determined based on a ratio of cross-correlation between a desired signal and a main signal over total power.

12. The system of claim 8, wherein the at least one voice activity detector further includes a third voice activity detector operative to provide a third voice detection signal based on the reference signal and the beam-formed signal, and wherein the multi-channel noise suppressor is operative to suppress noise and interference in the beam-formed signal based on the third voice detection signal.

13. The system of claim 12, wherein the third voice detection signal is determined based on a power ratio of the beam-formed signal over a reference noise signal.

14. The system of claim 1, wherein the array microphone comprises one omni-directional microphone and two uni-directional microphones.

15. The system of claim 14, wherein the omni-directional microphone is designated as a main channel and the two unidirectional microphones are designated as secondary channels.

16. The system of claim 14, wherein one of the two unidirectional microphones faces toward a voice signal source and the other one of the two uni-directional microphones faces away from the voice signal source.

17. The system of claim 16, wherein the first set of received signals includes a main received signal from the omni-directional microphone and a first secondary received signal from the uni-directional microphone facing toward the voice signal source, and wherein the second set of received signals includes the main received signal and a second secondary received signal from the uni-directional microphone facing away from the voice signal source.

18. The system of claim 1, wherein the array microphone comprises one omni-directional microphone and one uni-directional microphone.

19. The system of claim 18, wherein the uni-directional microphone faces toward a voice signal source, and wherein the first and second sets of received signals both include a main received signal from the uni-directional microphone and a secondary received signal from the omni-directional microphone.

20. An apparatus comprising:

means for obtaining a plurality of received signals from a plurality of microphones forming an array microphone, wherein the plurality of microphones include at least one omni-directional microphone and at least one uni-directional microphone;

means for providing first and second voice detection signals based on the plurality of received signals;

means for providing a reference signal based on the first voice detection signal and a first set of received signals selected from among the plurality of received signals;

means for providing a beam-formed signal based on the second voice detection signal, the reference signal, and a second set of received signals selected from among the plurality of received signals, wherein the beam-formed signal has noise and interference suppressed; and means for suppressing additional noise and interference in the beam-formed signal to provide an output signal.

21. The apparatus of claim 20, wherein the plurality of microphones include one omni-directional microphone and two uni-directional microphones, and wherein one of the two uni-directional microphones faces toward a voice signal source and the other one of the two uni-directional microphones faces away from the voice signal source.

22. A method of suppressing noise and interference, comprising:

obtaining a plurality of received signals from a plurality of microphones forming an array microphone, wherein the plurality of microphones include at least one omni-directional microphone and at least one uni-directional microphone;

providing first and second voice detection signals based on the plurality of received signals;

providing a reference signal based on the first voice detection signal and a first set of received signals selected from among the plurality of received signals;

providing a beam-formed signal based on the second voice detection signal, the reference signal, and a second set of received signals selected from among the plurality of received signals, wherein the beam-formed signal has noise and interference suppressed; and suppressing additional noise and interference in the beam-formed signal to provide an output signal.

23. The method of claim 22, wherein the reference signal and beam-formed signal are provided using time-domain signal processing, and wherein the suppressing is performed using frequency-domain signal processing.

* * * * *